United States Patent [19]

Wyss

[11] 4,397,242

[45] Aug. 9, 1983

[54] CABLE DRIVEN SHUTTLE SYSTEM HAVING GUIDEWAYS OF DIFFERENT LENGTHS AND METHOD FOR ITS USE

[75] Inventor: Paul H. Wyss, Los Gatos, Calif.

[73] Assignee: VSL Corporation, Los Gatos, Calif.

[21] Appl. No.: 305,945

[22] Filed: Sep. 28, 1981

[51] Int. Cl.[3] ..... B61B 1/00

[52] U.S. Cl. ..... 104/173 R; 104/89; 104/162

[58] Field of Search ..... 104/89, 162, 165, 173 R, 104/177; 198/743, 748

[56] References Cited

U.S. PATENT DOCUMENTS

| | | | |
|---|---|---|---|
| 1,881,828 | 10/1932 | Millar et al. | 104/162 |
| 2,575,396 | 11/1951 | Schenk | 104/162 |
| 3,538,854 | 11/1970 | Oranczak et al. | 104/173 R X |
| 3,720,172 | 3/1973 | Dehne | 104/89 X |
| 4,344,363 | 8/1982 | Veith | 104/162 |

*Primary Examiner*—Bruce H. Stoner, Jr.
*Assistant Examiner*—David F. Hubbuch
*Attorney, Agent, or Firm*—Flehr, Hohbach, Test, Albritton & Herbert

[57] ABSTRACT

A shuttle system using first and second cable driven cars and a drive cable for transporting passengers between first and second spaced apart stations on laterally spaced apart car supporting guideways is disclosed herein. The system is designed such that a first guideway is necessarily shorter than the second guideway by a predetermined amount. Therefore, while the first passenger car can be moved along the first guideway to and between the spaced apart stations by means of the drive cable directly, the second passenger car cannot be moved along the second guideway entirely to and between the stations by means of the drive cable directly. Rather, because the first guideway is shorter than the second guideway, the second car can be moved directly by the drive cable only between one of the stations and a predetermined point on the second guideway short of the other station by an amount equal to the difference in length of the two guideways. However, the shuttle system disclosed herein includes an arrangement which ensures that both passenger cars move into each of the stations even though one of the guideways is shorter than the other.

12 Claims, 5 Drawing Figures

CABLE DRIVEN SHUTTLE SYSTEM HAVING GUIDEWAYS OF DIFFERENT LENGTHS AND METHOD FOR ITS USE

The present invention relates generally to shuttle type systems for transporting passengers between spaced apart stations and more particularly to a system which uses a cable to move cable driven passenger cars between the stations on associated guideways which are required to be of different lengths.

VSL Corporation of Los Gatos, Calif. has recently developed a shuttle system in which cable driven cars are used for transporting passengers between first and second spaced apart stations. This system includes first and second laterally spaced apart guideways extending between the stations and first and second cable driven cars respectively supported by the first and second guideways. A continuous closed drive cable also comprises part of the overall shuttle system and forms a looped path between the two stations such that one section of the cable is always coextensive with the first guideway and the second section of the cable is always coextensive with the second guideway. In this way, by fixably connecting the passenger cars to specific segments of the cable, the latter can be driven back and forth about its looped path for simultaneously moving the cars between stations along their respective guideways, in opposite directions.

In the shuttle system thus far described, if the first and second guideways are equidistant between stations, the passenger cars can be fixedly connected directly to the cables and both cars can be moved to and between both stations merely by moving the drive cable in a particular way. More specifically, by connecting the first car to a first predetermined point on the cable and by connecting the second car to a second predetermined point on the cable and by driving the cable back and forth along its looped path in a predetermined way, the first car can be made to move back and forth between the first and second station while the second car moves back and forth between the second and first station, that is, in the opposite direction as the first car. On the other hand, as in the case of the present invention, design requirements may dictate that one guideway be shorter than the second guideway by a predetermined amount. For example, this is the case where the drive cable extends between stations in an elongated curved loop and where the two guideways are respectively coextensive with the inside and outside curves of the loop. It has been found that by fixedly connecting the passenger cars to the drive cable directly, as discussed above, and by moving the drive cable back and forth in a way which, for example, moves the car on the shorter guideway between stations, the car on the longer guideway will only move the same distance as the car on the shorter guideway and therefore not the entire length of its guideway.

One possible way of solving the problem just described is to make the passenger stations sufficiently large so that platforms associated with the second car, that is the one on the longer guideway, are the same distance from one another as the platforms associated with the first car and shorter guideway, even though the second guideway is longer than the first one. This means the two platforms in each station must be staggered relative to one another and that the stations must be sufficiently large to accommodate such an arrangement. This can be costly, especially where space is at a premium, and in some cases, it may not be possible at all to provide the space needed to provide the appropriately staggered platforms or staggered platforms may be aesthetically unacceptable.

Accordingly, it is an object of the present invention to provide an uncomplicated and yet reliable way of ensuring that both cars move simultaneously and in opposite directions entirely between passenger stations, even though one of the guideways is shorter than the other and without requiring staggered platforms.

Another object of the present invention is to provide a shuttle system of the general type described above and one which achieves the objective just recited without requiring a slippage type of connection between either of the passenger cars and the drive cable.

As will be described in more detail hereinafter, the shuttle system disclosed herein is one which utilizes first and second cable driven passenger cars supported for movement along respective first and second laterally spaced apart guideways extending between two passenger stations. Design requirements dictate that the first guideway be shorter than the second guideway by a predetermined amount. However, the overall shuttle system includes a passenger car drive arrangement which takes this design requirement into account in an uncomplicated and yet reliable way. More specifically, the drive arrangement includes a continuous closed cable forming a looped path between the stations such that a first section of the cable is always coextensive with the first guideway and a second section of the cable is always coextensive with the second guideway. The two passenger cars are connected to the drive cable in a predetermined way and the latter is moved back and forth so as to cause the first car to move along the entire first guideway between the two stations while, at the same time, the second car moves in the opposite direction along the entire second guideway between the two stations, even though the first guideway is shorter in length than the second guideway. In a preferred embodiment, the first car is connected directly to and moves between stations as a direct result of the back and forth movement of the drive cable. In this same preferred embodiment, the second passenger car is connected to the drive cable by an intermediate car puller mechanism which moves along the second guideway the same distance as the first car and therefore not the entire length of the second guideway. At the same time, the second car is connected with and moves relative to the puller so as to complete the distance along the second guideway and in this way moves entirely between the two stations in the same manner as the first car.

The overall system disclosed herein will be described in more detail hereinafter in conjunction with the drawings wherein.

Figure 1:
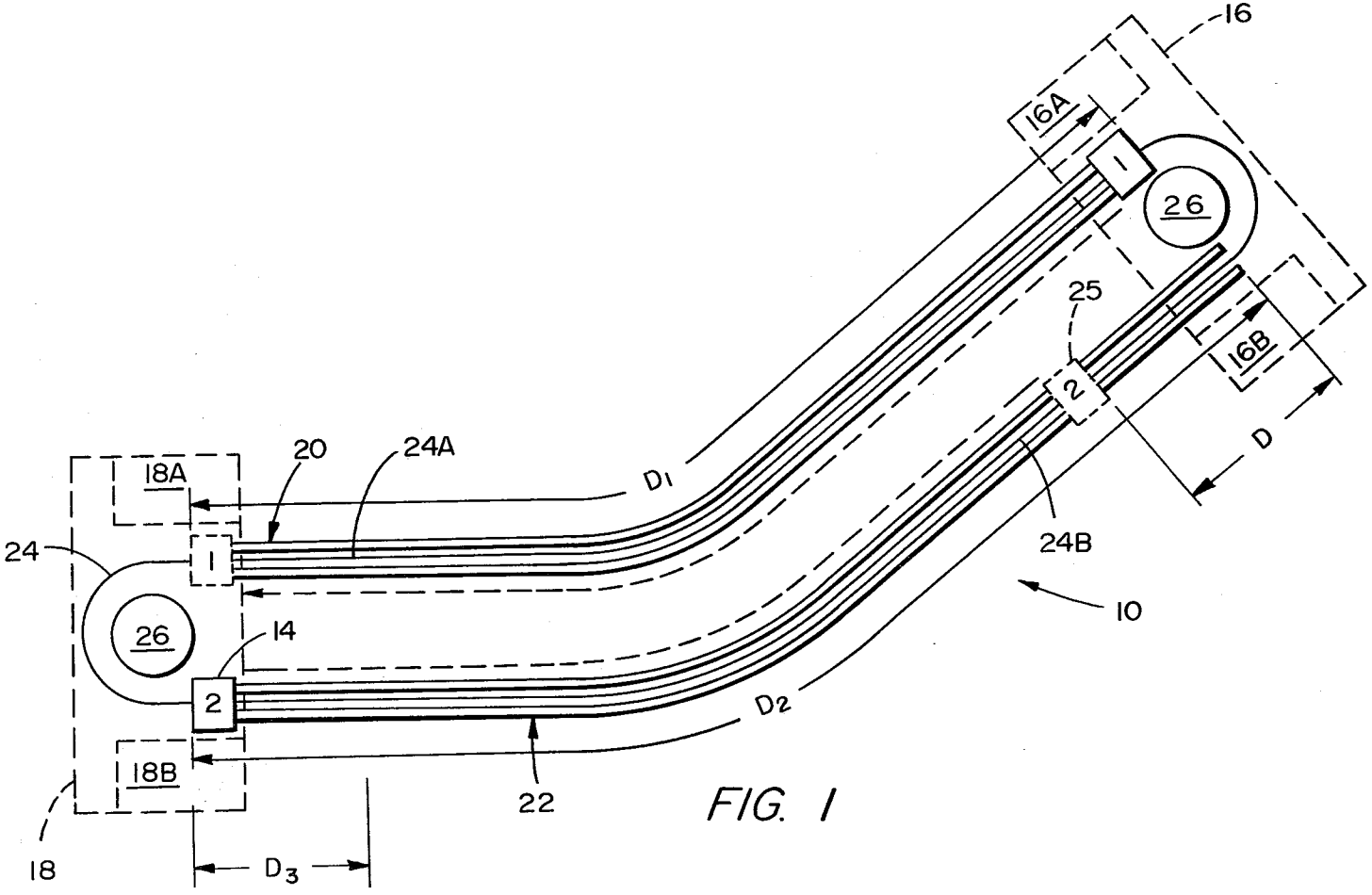
FIG. 1 is plan view diagrammatically illustrating the shuttle system disclosed herein, which system is designed in accordance with the present invention.

Turning now to the drawings wherein like components are designated by like reference numerals throughout the various figures, attention is first directed to FIG. 1 which is a plan view diagrammatically illustrating a shuttle system 10 designed in accordance with the present invention. This system uses two cable driven cars 12 and 14 for transporting passengers between first and second spaced apart stations generally indicated at 16 and 18. As seen in FIG. 1, station 16 includes laterally aligned passenger platforms **16*a*,16*b* and station 18 includes laterally aligned passenger platforms 18*a*,18*b*. As will be described in more detail hereinafter, the two passenger cars 12 and 14 are respectively supported for movement by laterally spaced apart car supporting guideways 20 and 22 which extend between stations 16 and 18 in a curved fashion. More specifically, guideway 20 extends between passenger platforms 16*a* and 18*a* and forms the inside of the curve while guideway 22 extends between passenger platforms 16*b* and 18*b* and forms the outside of the curve. Thus, guideway 20 which extends a distance $D_1$ is shorter than guideway 22** which extends a distance $D_2$ by an amount D. This difference significantly affects the way in which the overall system must be operated in order to move the two cars between the stations, as will be seen hereinafter.

In addition to passenger cars 12,14 and their associated guideways 20,22, overall shuttle system 10 includes a continuous closed drive cable 24 forming a looped path between stations 16,18 such that one of its sections generally indicated at **24*a* is always coextensive with guideway 20 and such that a second cable section 24*b* is always coextensive with the second guideway 22. Means generally indicated at 26 serve to support the ends of drive cable 24** and also drive the latter back and forth along its looped path in a predetermined way to be discussed below. The specific way in which this is accomplished and, in fact, the way the entire cable is supported and the way in which the two guideways are supported do not form part of the present invention and, hence, will not be described herein. It suffices to say that the cable and guideways can be readily supported in the positions shown and the cable can be readily moved back and forth in the manner to be discussed.

As will be discussed hereinafter with respect to FIGS. 2, 3 and 4A, 4B, passenger car 12 is fixedly connected to a predetermined segment of cable 24 so as to move along guideway 20 between passenger platforms **16*a* and 18*a* in response to and as a direct result of predetermined back and forth movement of cable 24 along its looped path. Stating this another way, the cable is moved back and forth along its looped path in a way which causes the passenger car 12 to move along guideway 20 between passenger platforms 16*a* and 18*a*. At the same time, if passenger car 14 is directly fixedly connected to cable 24 at platform 18*b* when the passenger car 12 is at platform 16*a*, then movement of car 12 to platform 18*a* by cable 24 will simultaneously and automatically cause the car 14 to move towards but stop short of platform 16*b* along guideway 22 by the amount D. In other words, under these circumstances, the passenger car 14 will only reach point 25 on guideway 22 which is short of platform 16 by the distance D. As will be seen hereinafter, system 10 includes means designed in accordance with the present invention to ensure that car 14 does, in fact, move into station 16 and adjacent platform 16*b* in an uncomplicated and reliable way. Cable 24** has been described as a continuous member defining a closed loop. It should be apparent that separate cable means which operate together in the same manner as a single continuous cable could be provided.

Figure 2:
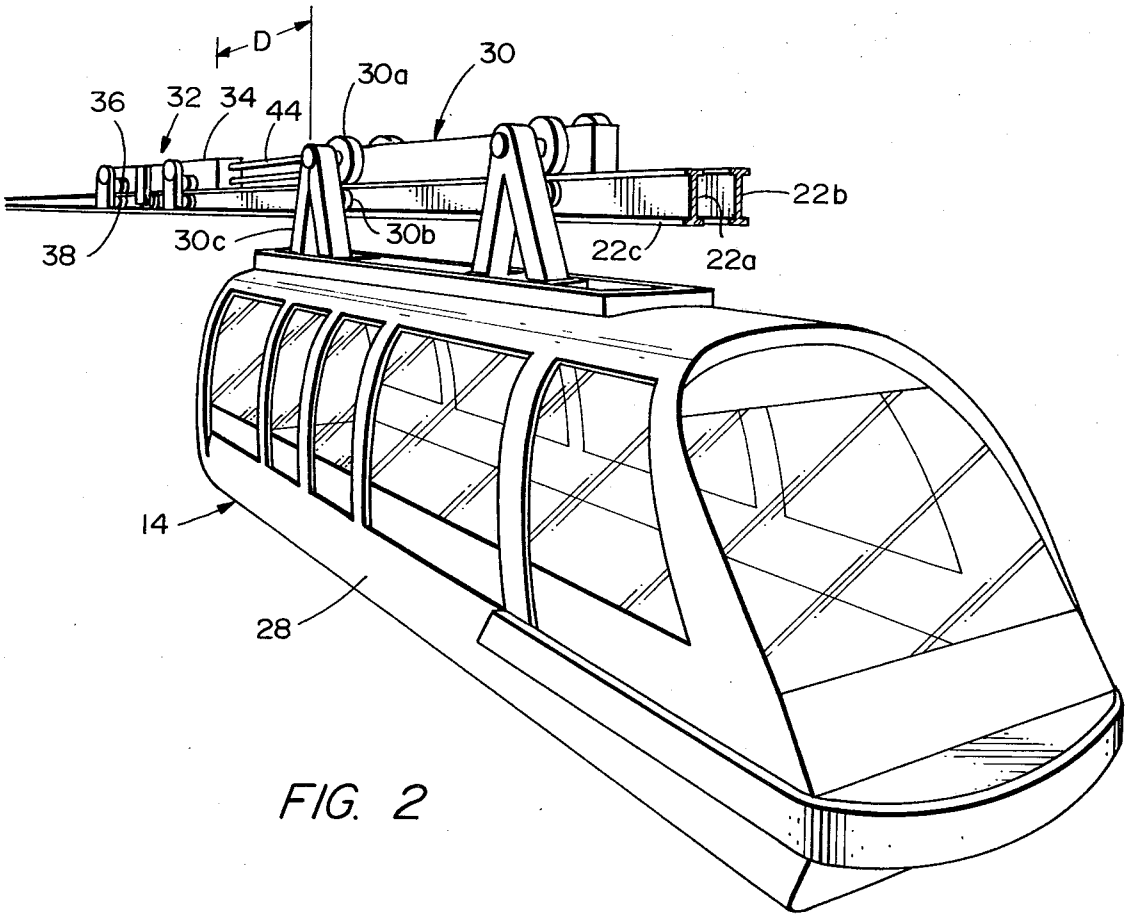
FIG. 2 is a perspective view illustrating one of the passenger cars forming part of the system of FIG. 1 along with a section of an associated guideway and means in connecting the passenger car with the guideway.

Turning to FIG. 2, attention is directed to passenger car 14 which, as shown, includes a cabin 28 for carrying passengers and suitable means generally indicated at 30 for supporting cabin 28 to and for movement along guideway 22. In the specific embodiment illustrated, guideway 22 is formed from two laterally spaced and confronting I-beams **22*a*,22*b* interconnected by longitudinally spaced struts 22*c*. Support means 30 include a plurality of wheels 30*a*, rollers 30*b* and interconnecting flanges 30*c* which cooperate with one another and with the guideway 22 and cabin 28 for moving the latter along the guideway in an interlocked rolling or sliding fashion. Since both guideway 22 and means 30 can be readily provided and do not per se form the present invention, neither of these components will be described further and can be readily modified. In this regard, it is to be understood that guideway 20 may be identical to guideway 22, with the exception of the way in which it is curved and its shorter length. Moreover, with certain exceptions to be noted, passenger car 12 may be identical to passenger car 14, that is, the passenger car 12 may include an identical or similar cabin and means for supporting this cabin to and along guideway 20. However, passenger car 12 is fixedly connected directly to a predetermined segment of cable 24 by suitable means (not shown) so as to cause the car to move along guideway 20 in the manner described previously with respect to FIG. 1. On the other hand, as will be seen below, car 14 is not fixedly connected directly to cable 24** but is rather allowed to move relative to the cable in order to make up the difference in distance between the two guideways.

In order to connect passenger car 14 to cable 24 indirectly, that is, for limited movement relative to the latter, system 10 includes what may be referred to as a car puller generally designated by the reference numeral 32. This device includes a main body 34 interlocked to guideway 22 for rolling or sliding movement along the latter by suitable wheels 36 and guide rollers 38. While not shown, the device 32 also includes suitable means for fixedly connecting body 34 directly to cable 24 at a point on the cable such that the puller is located at platform **18*b* when car 12 is located at platform 16*a*. In this way, as the cable 24 is moved back and forth in the manner recited previously, to move car 12 back and forth between platforms 16*a* and 18*a*, puller 32 is simultaneously caused to move back and forth between platform 18*b* and point 25 on guideway 22**.

Figure 3:
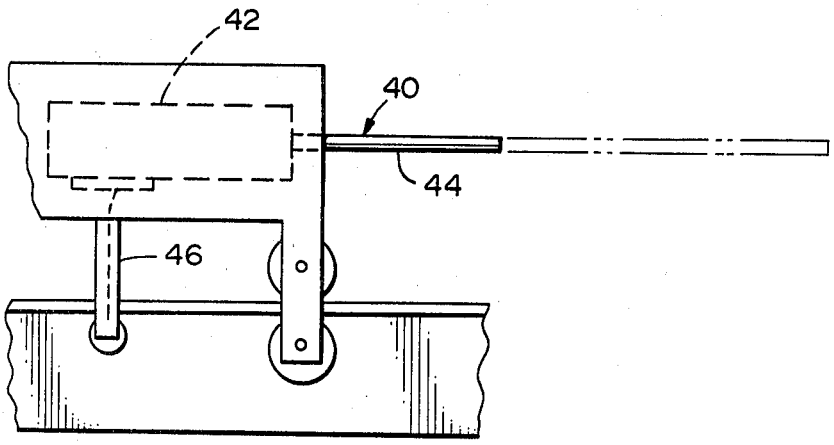
FIG. 3 is side elevational view diagrammatically illustrating a specific feature of the system of FIG. 1.

In accordance with the present invention, puller 32 includes a hydraulic cylinder arrangement generally indicated at 40 in FIG. 3. This arrangement includes a cylinder 42 fixedly mounted on puller body 34 and a piston 44 extending out one end of the puller body from the cylinder. Arrangement 40 also includes suitable hydraulic means for moving piston 44 between its retracted position shown by solid lines in FIG. 3 and its extended position shown by dotted lines. As best seen in FIG. 2, the otherwise free end of piston 44 is fixedly connected to support means 30 forming part of overall passenger car 14 such that movement of piston 44 between its retracted and extended positions causes the passenger car 14 to move on guideway 20 relative to puller body 34 and cable 24. More specifically, when piston 44 is in its retracted position, passenger car 14 is disposed directly adjacent to puller body 34 and, when the piston is in its extended position, the passenger car is maintained a predetermined distance from the puller body, specifically the distance D. While only suitable hydraulic means and associated controls may be utilized to accomplish this, for reasons to be discussed below it is preferred that the controls include means generally indicated at 46 for sensing the position of puller body 34 along guideway 22. More specifically, means 46 cooperates with the hydraulic cylinder arrangement to cause piston 44 to gradually move from its retracted position when the puller is located at platform 18*b* to its extended position as the puller moves to point 25 and back to its original retracted position when the puller moves back to platform 18*b*. The reason for this will become apparent below.

Figure 4A:
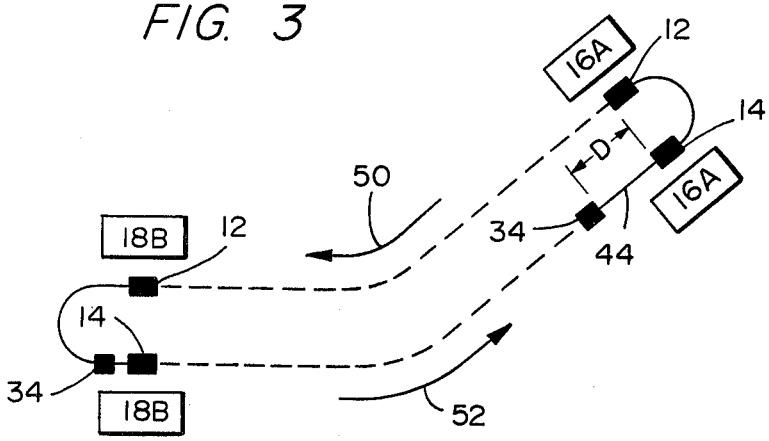
FIGS. 4A and 4B are diagrammatic illustrations of the way in which the system illustrated in FIGS. 1–3 operates to move two cable driven passenger cars along associated guideway between two spaced apart stations.
Figure 4B:
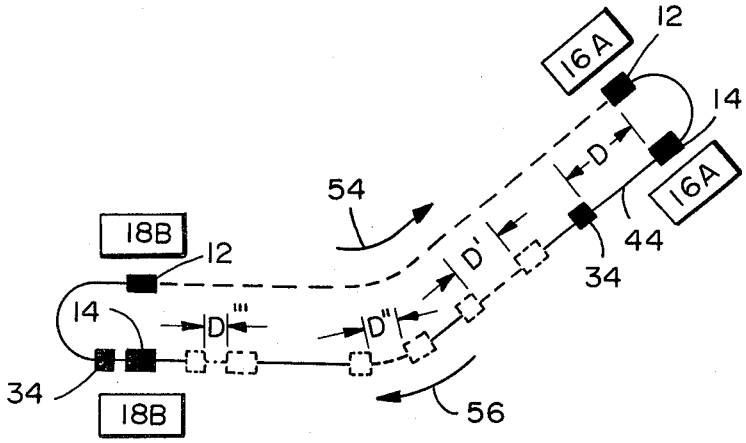

Referring to FIGS. 4A and 4B, attention is now directed to the way in which shuttle system 10 operates to transport passengers between stations 16 and 18. For the purpose of this description, it will be assumed that passenger car 12 is initially in station 16 at platform 16*a* and that passenger car 14 is in station 18 at platform 18*b*. At the same time, piston 44 is in its retracted position so that puller body 34 is disposed adjacent to passenger car 14 at platform 18*b*. In order to move car 12 to platform 18*a* in station 18, cable 24 is moved in the appropriate direction along its looped path thereby causing it to pull car 12 along guideway 20 until the car reaches platform 18*a*, as indicated by the arrow 50 in FIG. 4A. At the same time, puller 34 is moved by the cable from platform 18*b* to point 25 along guideway 22, as indicated by the arrow 52. Simultaneously therewith, means 46 causes piston 44 to move from its retracted position to its extended position which, in turn, pushes car 18 into station 16 at a point adjacent platform 16*b*. Then, even though puller body 34 does not reach platform 16*b*, the passenger car 14 does. In order to return the two cars to their starting stations, the cable 24 is turned in the opposite direction. This simultaneously moves car 12 back to platform 16*a* as indicated by arrow 54 in FIG. 4B and puller body 34 back to platform 18*b*, as indicated by arrow 56. As the puller body moves back to its starting station, means 46 causes piston 44 to move back to its retracted position, thereby pulling car 14 back into position adjacent platform 18*b*.

It should be apparent from the foregoing that car 14 is moved into stations 16 and 18 even though guideway 22 is longer than guideway 20. Moreover, while this could be accomplished by providing some form of cable slipping mechanism between the cabin forming part of car 12 and its point of connection on cable 24, this type of connection is preferably not utilized. Rather, it is preferred to interconnect each car with the cables such that there is no direct sliding movement therebetween. In the case of system 10 described above, car 12 is fixedly connected directly to cable 24 and car puller 32 is fixedly connected directly to the cable. Car 14 is not connected to the cable at all, but rather moves relative to the latter and to puller 32. Moreover, while any suitable means may be provided for moving car 14 relative to puller 32, it is preferably moved in the manner described. Of course, it is not necessary that car 14 be moved gradually relative to the car puller, although this gradual change in position between the two is less obvious to the passengers. Also, while the cars 12 and 14 are shown suspended from respective guideways 20 and 22, the cars could for example be supported on top suitable designed guideways.

What is claimed is:

1. A shuttle system using cable driven cars for transporting passengers between first and second spaced apart stations comprising:

(a) first and second laterally spaced apart car supporting guideways extending between said stations, said first guideway being shorter than said second guideway by a predetermined amount;

(b) first and second cable driven passenger cars including respective cabins for carrying passengers and respective means for supporting said cabins to said first and second guideways for movement along the latter between said stations; and (c) a passenger car drive arrangement including (i) cable means forming a looped path between said stations, said cable means always having a first section coextensive with said first guideway and a second section coextensive with said second guideway, (ii) means supporting said cable means for limited back and forth movement along said looped path, (iii) means for moving said cable means a predetermined distance back and forth along said path, and (iv) means connecting said first and second passenger cars to said cable means such that said back and forth movement of the latter causes said first car to move along said first guideway between said first and second stations while, at the same time, said second car moves in the opposite direction along said second guideway between said second and first stations, even though said first guideway is shorter than said second guideway.

2. A shuttle system according to claim 1 wherein said back and forth movement by itself directly causes one of said cars to move between said first and second stations and wherein said connecting means includes means for moving the other one of said passenger cars relative to said cable means in a way which causes said other car to move to each of said stations.

3. A shuttle system according to claim 2 wherein said cable moving means moves said cable means along said looped path such that a first predetermined segment of said cable means moves back and forth along said first guideway between said first and second stations while, at the same time, a second predetermined segment of said cable means moves back and forth along said second guideway between said second station and a predetermined point on said second guideway just short of said first station by said predetermined amount, said connecting means including:

(a) means for fixedly connecting said first car to said first cable segment whereby to move said first car along said first guideway between said station during movement of said cable;

(b) a car puller mounted for movement on said second guideway;

(c) means for fixedly connecting said car puller with and adjacent to said second cable segment; and (d) means for connecting said second car with said puller in a way which causes said second car to move between said first and second station during said movement of said cable means even though said car puller only moves between said second station and said point short of said first station.

4. A shuttle system according to claim 3 wherein said means for connecting said second car with said puller includes piston means for moving said second car relative to both said puller and said cable means between a retracted position adjacent said puller and an extended position a predetermined distance closer to said first station sufficient to place sa' ' second car in said second station when said puller is at said predetermined point on said second guideway just short of said first station.

5. A shuttle system according to claim 4 wherein said piston means is supported by and moves with said puller along said second guidew ay, said piston means including means responsive to the movement of said puller between its position at said second station and said predetermined point for moving said second car between its retracted and extended positions simultaneously and in synchronism with the movement of the puller.

6. A shuttle system according to claim 1 wherein said guideways are located predetermined distances above the ground and wherein said means for supporting each of said cabins to an associated one of the guideways includes means for suspending said cabin from and below its guideway.

7. A shuttle system using cable driven cars for transporting passengers between first and second spaced apart stations, comprising:

(a) first and second laterally spaced apart car supporting guideways extending between said stations, said first guideway being shorter than said second guideway by a predetermined amount;

(b) first and second cable driven passenger cars including respective cabins for carrying passengers and respective means for supporting said cabins to said first and second guideways for movement along the latter between said stations; and (c) a passenger car drive arrangement including (i) a continuous closed cable forming a looped path between said stations, said cable always having a first section coextensive with said first guideway and a second section coextensive with said second guideway, (ii) means supporting said cable for limited back and forth movement along said looped path, (iii) means for moving said cable back and forth along said path such that a first predetermined segment of said cable moves back and forth along said first guideway between said first and second stations while, at the same time, a second predetermined segment of said cable moves back and forth along said second guideway between said second station and a predetermined point on said second guideway just short of said first station by said predetermined amount, (iv) first means connecting said first car with and adjacent to said first predetermined cable segment for movement therewith whereby to move said first car between said stations, and (v) second means connecting said second car with and adjacent to said second predetermined cable segment whereby to move said second car between said second station and said predetermined point on said second guideway, said second connecting means including means for moving said second car into said first station from said predetermined point and back to a point adjacent said second cable segment when the latter is at said second station.

8. A method of transporting passengers between first and second spaced apart stations, comprising the steps of:

(a) providing first and second laterally spaced apart car supporting guideways extending between said stations such that said first guideway is shorter than said second guideway by a predetermined amount;

(b) providing first and second cable driven passenger cars having respective cabins for carrying passengers and respectively supporting said cabins to said first and second guideways for movement along said guideways between said stations;

(c) supporting cable forming a looped path between said stations such that a first section of the cable is always coextensive with said first guideway and such that a second section is always conextensive with said second guideway;

(d) connecting said first and second passenger cars with predetermined first and second segments of said cable and moving said cable back and forth a predetermined distance along said path so as to cause said first car to move along said first guideway between said first and second stations while, at the same time, said second car moves along said second guideway, in the opposite direction, between said second and first stations, even though said first guideway is shorter than said second guideway.

9. A method according to claim 8 wherein the back and forth movement of said cable itself directly causes one of said passenger cars to move between said first and second stations, said method including the step of moving the other one of said cars relative to said cable in a way which causes said other car to move to and between said stations.

10. A method according to claim 9 wherein said first and second cars are respectively connected to first and second predetermined segments of said cable, wherein said cable is moved such that said first cable segment moves back and forth along said first guideway between said first and second stations while, at the same time, said second cable segment moves back and forth along said second guideway between said second station and a predetermined point on said second guideway just short of said first station by said predetermined amount, and wherein said second car is moved relative to said cable from said second cable segment when the latter is at said predetermined point to said first station, and back to a position adjacent said second cable segment when the latter is at said second station.

11. The method according to claim 10 including the steps of:

(a) fixedly connecting said first passenger car directly to said first cable segment and connecting said second passenger car to said second cable segment by means of a car puller which is fixedly attached directly to and at said second cable segment and which is supported to said second guideway for movement therealong, said second car being connected to said puller for movement relative to both the latter and said cable between said retracted and extended positions; and (b) causing said second car to move between its retracted position adjacent said car puller when the latter is at said second station and said extended position when said second car is at said predetermined point on said second guideway, whereby to place said second car in said first station.

12. A method according to claim 11 wherein said second car is moved between its retracted and extended positions in response to and as a result of the movement of said car puller between its position at said second station and said predetermined point so as to move said second car between said retracted and extended positions simultaneously and in synchronism with movement of the car puller.

* * * * *